US005615869A

United States Patent [19]

Phillips et al.

[11] Patent Number: 5,615,869

[45] Date of Patent: Apr. 1, 1997

[54] TORSION SPRING ASSEMBLY

[75] Inventors: Herman R. Phillips, Bennett; Fred L. Ingle, West End, both of N.C.

[73] Assignee: Lancer, Inc., Star, N.C.

[21] Appl. No.: 639,343

[22] Filed: Apr. 26, 1996

Related U.S. Application Data

[63] Continuation of Ser. No. 417,081, May 12, 1995, abandoned.

[51] Int. Cl.[6] ..... F16F 3/00

[52] U.S. Cl. ..... 267/103

[58] Field of Search ..... 267/95, 103, 105, 267/104, 154, 155, 142, 143; 5/257, 261, 267, 478

[56] References Cited

U.S. PATENT DOCUMENTS

| | | | |
|---|---|---|---|
| 1,815,510 | 7/1931 | Hotter | 5/267 |
| 1,899,726 | 2/1933 | Rusnak | 5/261 |
| 2,013,573 | 9/1935 | McNally | 5/267 |
| 2,042,763 | 6/1936 | Bernstein | 267/112 |
| 2,055,213 | 9/1936 | Bernstein | 267/112 |
| 2,849,057 | 8/1958 | Neely | 267/107 |
| 4,398,705 | 8/1983 | Mizelle | 267/103 |
| 4,819,920 | 4/1989 | Barber | 267/110 |
| 4,886,250 | 12/1989 | Lucas | 267/95 |
| 4,903,949 | 2/1990 | Schultz | 267/103 |
| 4,928,334 | 5/1990 | Kita | 297/452.63 |
| 5,165,667 | 11/1992 | Dabney | 267/110 |

*Primary Examiner*—Robert J. Oberleitner
*Assistant Examiner*—C. T. Bartz

[57] ABSTRACT

A torsion spring assembly for furniture seating and the like utilizes an intermediate spring of the coil or folded form type for durability and comfort purposes. Parallel lateral members are attached to the top of the intermediate springs which connect the intermediate springs and torsion springs for additional support and durability. A top stiffening frame can also be utilized to better unify the assembly components.

10 Claims, 4 Drawing Sheets

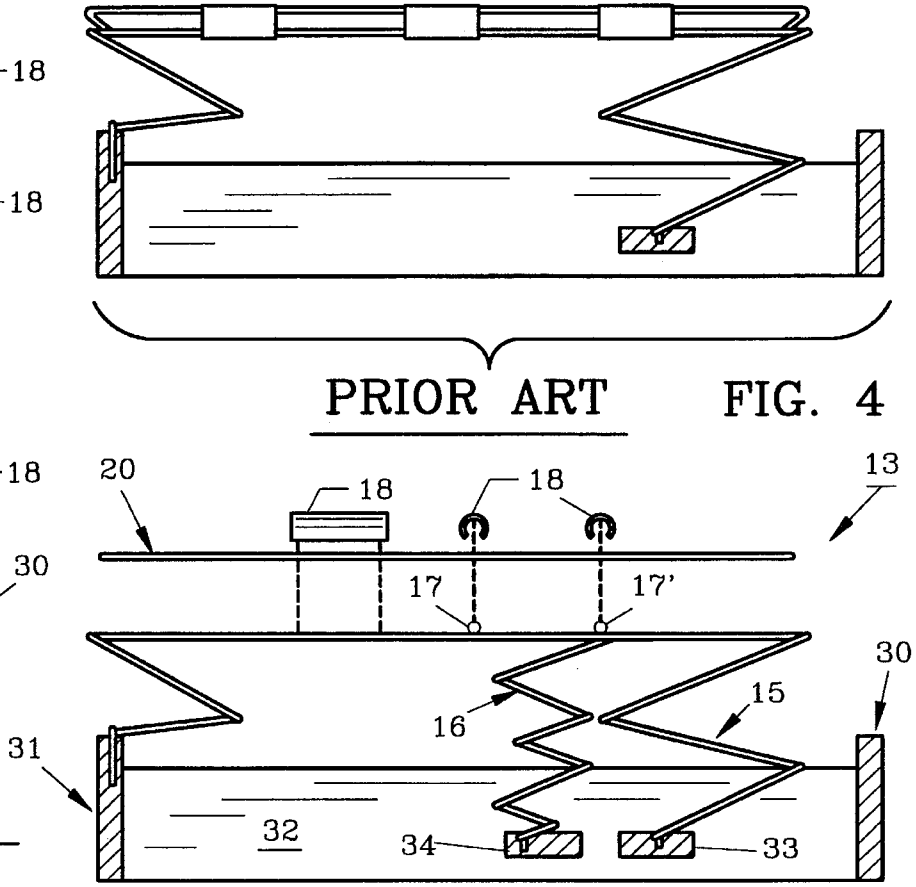
FIG. 3
PRIOR ART
FIG. 4
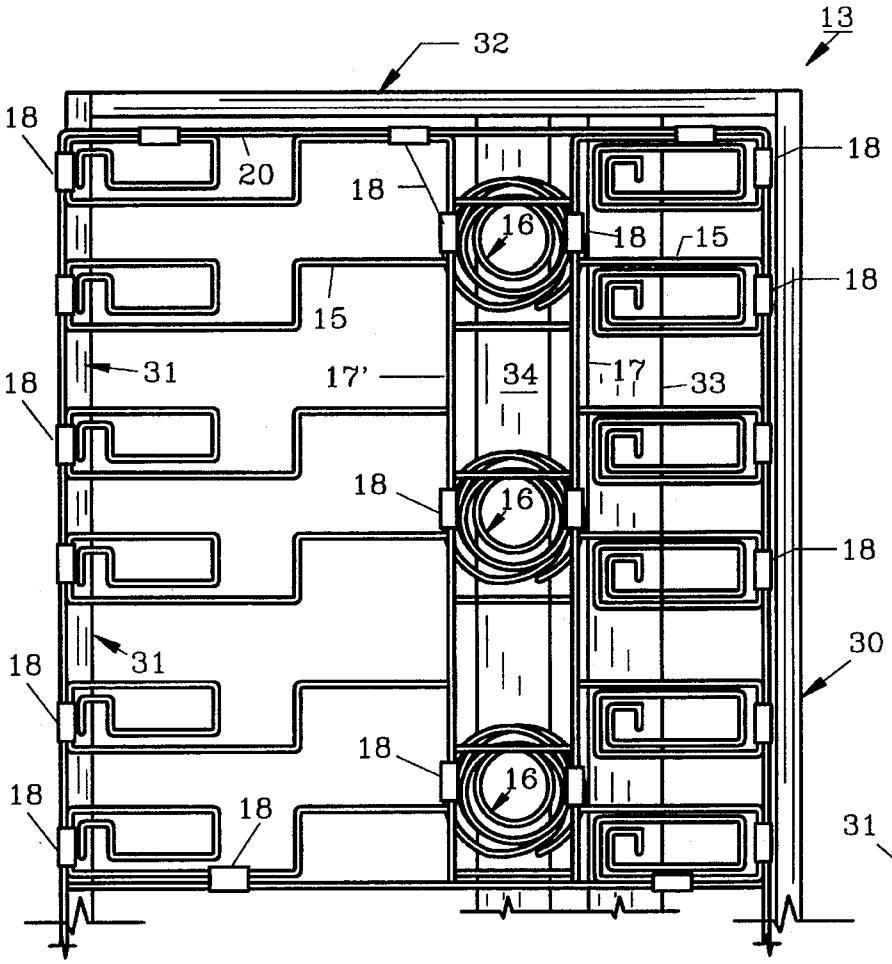
FIG. 2

TORSION SPRING ASSEMBLY

This is a continuation of patent application Ser. No. 08/417,081 filed 12 May 1995, now abandoned.

BACKGROUND OF THE INVENTION

1. Field of the Invention

The invention herein pertains to furniture seating and particularly pertains to seating utilizing a spring assembly having main torsion and intermediate support springs.

2. Description of the Prior Art and Objectives of the Invention

Furniture manufacturers have utilized various types of torsion spring assemblies in furniture seats for many years. While obtaining acceptance in the "lower end" market, torsion spring assemblies have not been received well in the "higher end" furniture since they do not have the comfort or feel of "eight-way tied" coil spring assemblies which are considered to be the ultimate in comfort and durability. Manufacturers do not generally like to use eight-way tied spring assemblies since they are expensive to manufacture, difficult to handle due to their weight and bulk, and require additional steps in the furniture manufacturing process. Torsion spring assemblies that have been used to date are relatively inexpensive to manufacture, weigh less, and are easier to handle, but soon lose their resiliency when compared to eight-way tied spring assemblies. Also, conventional coil spring assemblies do not provide the "unified" feel like the eight-way tied spring assemblies offer. Other manufacturers have utilized seamless springs which are connected along the front and rear rails of the seating and utilize a coil spring midway therealong to provide additional support. Such sinuous spring stuctures provide "hard" edges along the front and rear rails and are not favored in "high-end" furniture.

Thus, with the disadvantages and problems associated with prior art spring assemblies, the present invention was conceived and one of its objectives is to provide a spring assembly for furniture seating or the like utilizing a combination of torsion and intermediate coil or folded form springs to provide "soft" edges to the spring assembly.

It is another objective of the present invention to provide a spring assembly whereby intermediate springs are positioned near the rear of the spring assembly to provide additional support where seating weight is most heavily directed.

It is yet another objective of the present invention to provide a spring assembly in which intermediate springs are affixed to torsion springs by the use of lateral, parallel rods.

It is still another objective of the present invention to provide a spring assembly utilizing both torsion and intermediate springs which include a stiffening frame surrounding the top of the spring assembly.

It is a further objective of the present invention to provide a furniture frame for a sofa or the like which utilizes a wooden rectangular rail assembly with lateral internal rails for supporting the torsion and intermediate springs.

Various other objectives and advantages of the present invention will become apparent to those skilled in the art as a more detailed description is set forth below.

SUMMARY OF THE INVENTION

A spring assembly is provided for furniture or other seating having conventional parallel torsion springs with intermediate coil or folded form springs uniquely positioned therealong whereby the intermediate springs provide added resiliency at specific, critical positions. A seating frame is formed in the shape of a rectangle using standard wooden front, side, and rear rails. Conventional torsion springs are positioned in a front-to-rear configuration to insure "soft" edges with intermediate springs spaced laterally therealong and connected thereto. A vinyl-coated wire frame is affixed around the top perimeter of the torsion springs by conventional clamps or the like to provide unity to the assembly. A pair of lateral, vinyl-coated wires or rods of approximately the same diameter are attached with clamps in parallel along the top front and rear of the intermediate springs. The torsion and intermediate springs are securely joined together to provide a superior, reliable, light-weight spring assembly which gives the comfort and feel of the more expensive eight-way tied spring assemblies conventionally used while insuring a "soft" seating edge.

BRIEF DESCRIPTION OF THE DRAWINGS

FIG. 2 depicts a partial top view of the seat section of the furniture frame as shown in FIG. 1 with the lateral wire members in place therein;

FIG. 3 illustrates an exploded partial cross-sectional view of the seat section as shown in FIG. 2;

FIG. 4 demonstrates a partial cross-sectional side view of a prior art seat section utilizing standard torsion springs.

DETAILED DESCRIPTION OF THE PREFERRED EMBODIMENT AND OPERATION OF THE INVENTION

Figure 1:
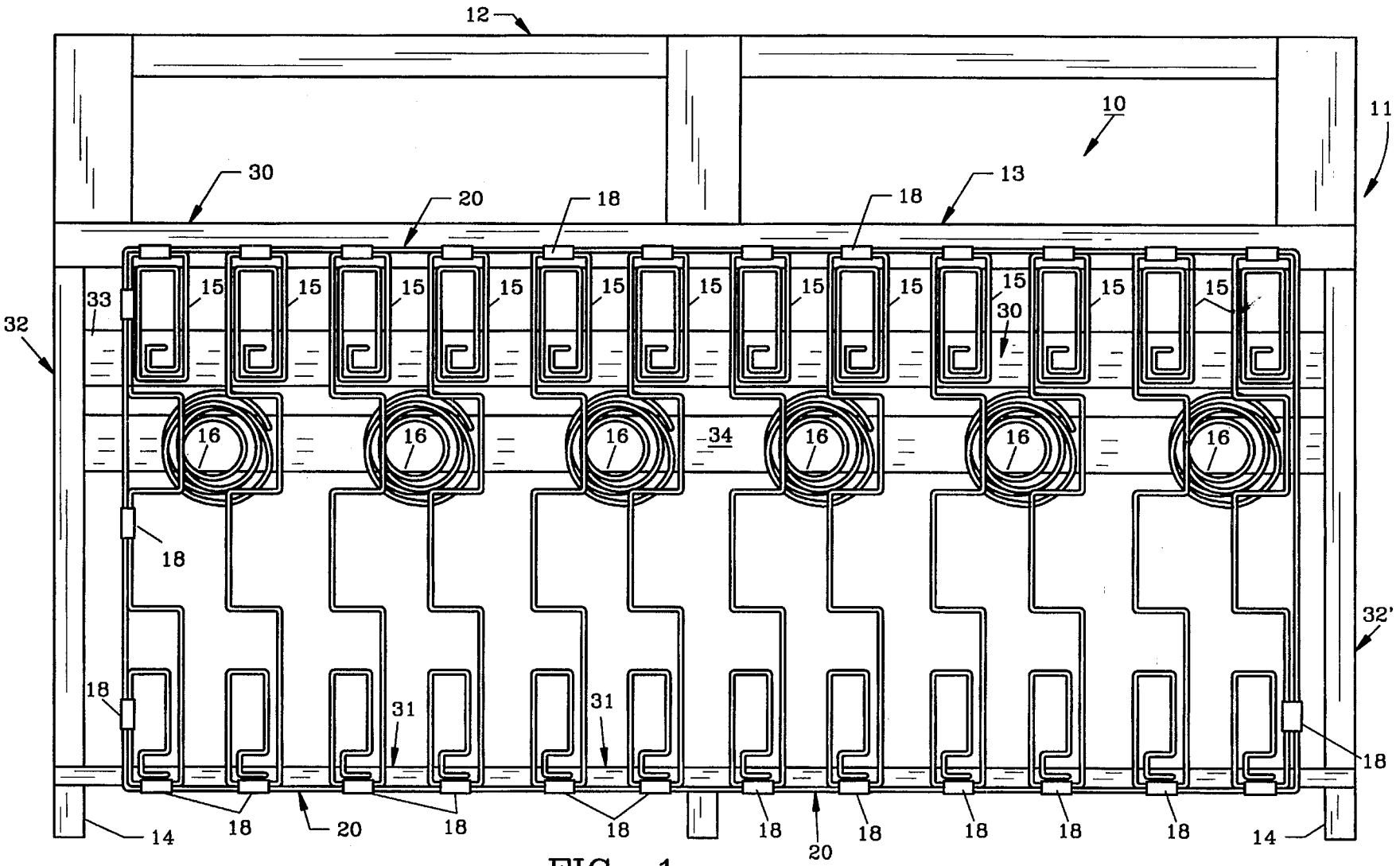
FIG. 1 shows a top view of a sofa frame utilizing the preferred spring assembly in the seat section, but without the lateral wire members shown for clarity.

Turning now to the drawings, as seen in FIG. 1, preferred spring assembly 10 is shown positioned in furniture frame 11 which consists of a modified conventional sofa frame in a top plan view. Furniture frame 11 is formed of wood and has a rectangular back section 12 joined to rectangular seat section 13. Furniture frame 11 is shown without upholstery which may include fabric webs or otherwise placed thereon prior to covering with padding, cushions, fabric, and the like. Seat section 13 is formed in a rectangular configuration utilizing joined wooden components as will be hereafter explained in more detail including front legs 14, and rear legs (not seen) attached to seat section 13.

Preferred spring assembly 10 includes a plurality of conventional parallel torsion springs 15 which are connected to intermediately placed coil springs 16 through a pair of parallel wire lateral members 17, 17', shown in FIG. 2. Coil springs 16 are joined to lateral members 17, 17' (not included in FIG. 1) by metal clips 18 which are urged thereon by squeezing such as with pliers or the like as is normal in the industry. Positioned completely around the perimeter of spring assembly 10 is a rectangular stiffening frame 20 which, like springs 15, 16 is formed from a rigid metal wire similar in construction to torsion spring 15, preferably covered with vinyl to reduce squeaks and noise. Stiffening frame 20 is also attached to torsion springs 15 by metal clips 18 shown therein. Stiffening frame 20 provides uniformity and durability to spring assembly 10 and is especially beneficial under constant harsh loads as may occur with children playing thereon.

In FIG. 2, the fragmented top view of spring assembly 10 is seen with coil springs 16 and with parallel lateral members 17, 17' joined thereto. Lateral members 17, 17' extend from side to side, across the opposing top edges of metal coil springs 16 and are affixed to both coil springs 16 by metal clips 18 and to torsion springs 15. Thus, lateral members 17, 17' provide support to spring assembly 10 completely across the width of the chair, sofa, or other seating structure. Torsion spring 15 and coil spring 16 are conventional springs as used in the furniture trade. However, coil springs 16, when utilized with torsion springs 15 increases the durability of the spring assembly by providing extra support near the rear or back rail 30 of seat section 13, where the majority of the loading occurs in normal use. Preferably intermediate coil springs 16 are spaced about one-third of the distance between front rail 31 and rear rail 30, nearest to rear rail 30.

As would be understood, seat section 13' consists of a large, elongated wooden rectangular frame formed by rear rail 30, front rail 31 and side rails 32, 32' as shown in FIG. 1 suitable for a sofa, but smaller frames could be configured for chairs or for other uses. Seat section 13 is joined together by nails, staples, adhesives or the like as is usual in the trade. Rear torsion spring support 33 as seen in FIG. 3 is likewise joined by conventional means to side rails 32, 32' and provides a support for affixing torsion springs 15. As is common in the industry, the ends of torsion and other springs are positioned in apertures formed in the wooden rails, supports, or the like. Coil spring rail 34, likewise shown in FIG. 3 consists of a wooden member, like rail 33, and is attached at each end to side rails 32, 32'. Coil spring rail 34 provides a base for coil springs 16 and as earlier explained, coil springs 16 are affixed to lateral members 17, 17' which are preferably vinyl covered rods of suitable diameter spanning, from side to side, spring assembly 10.

Rectangular stabilizer 20 is shown in FIG. 3 exploded from torsion spring 15 and coil spring 16, as are metal clips 18 used to affix stiffening frame 20 to torsion springs 15 and to lateral members 17, 17'.

Thus, with the spring assembly 10, a much longer life and more comfortable seating can be provided to the ultimate consumer by the combination of torsion and coil springs 15, 16 respectively as shown herein. The prior art embodiment as illustrated in FIG. 4 does not have the coil spring or lateral members as pictured in FIGS. 1, 2, and 3, or intermediate folded form springs seen in FIGS. 5 and 6.

Figure 5:
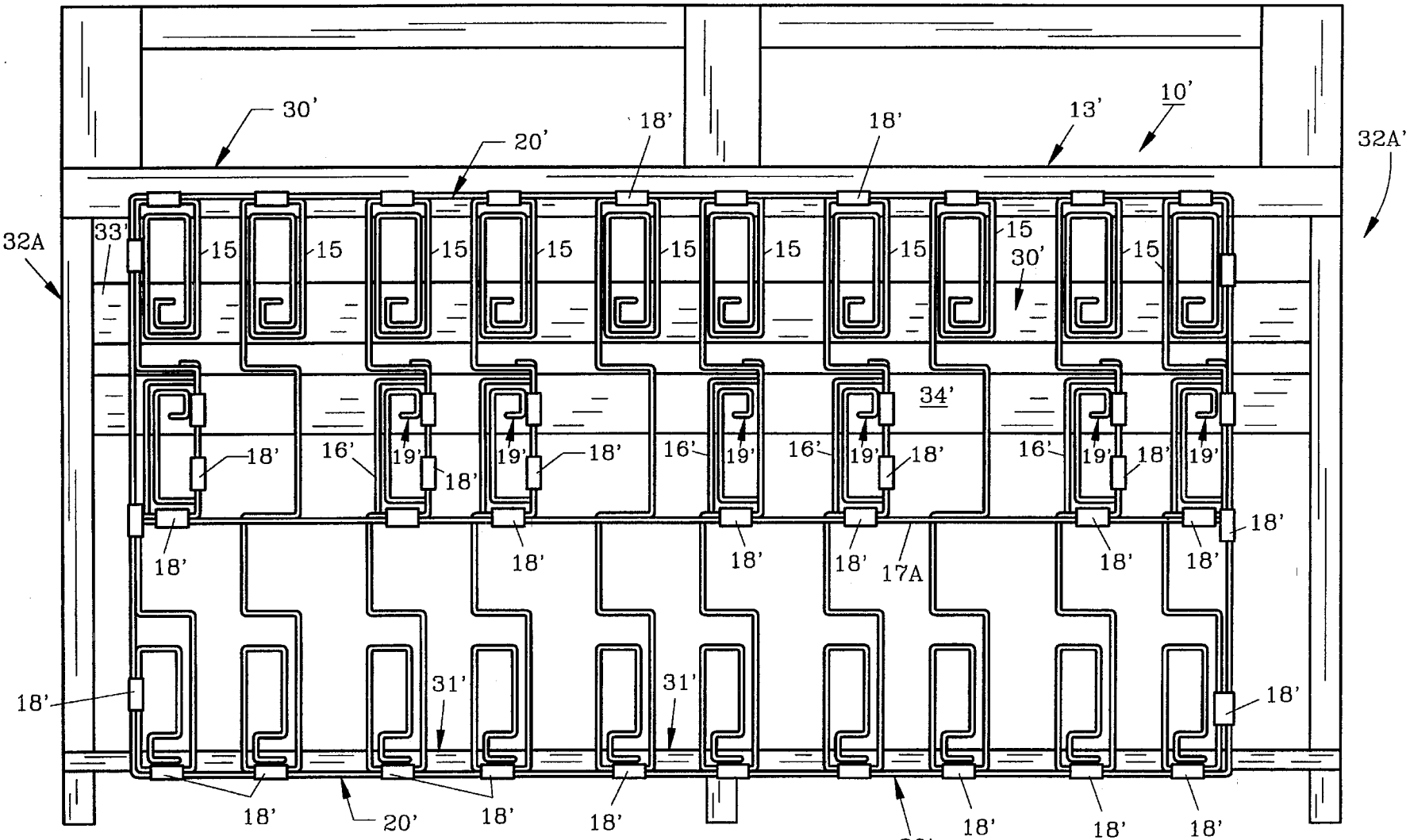
FIG. 5 shows a partial top view of a second embodiment of the spring assembly utilizing folded form intermediate springs.
Figure 6:
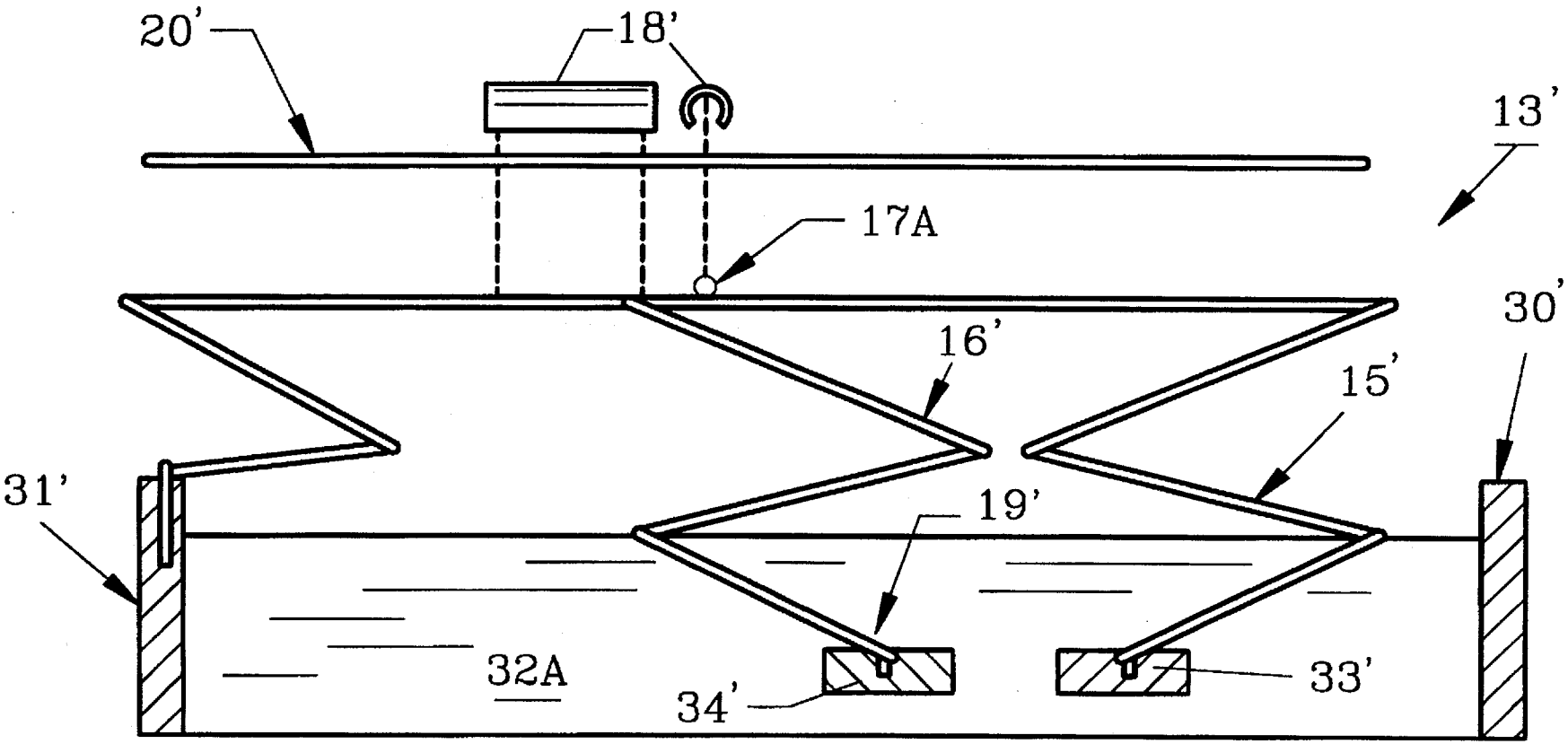
FIG. 6 pictures a side elevated view of the embodiment seen in FIG. 5.

Another embodiment, spring assembly 10', is shown in FIG. 5 whereby intermediate folded form springs 16' are attached to parallel torsion springs 15' as seen in FIG. 2. Thus, the embodiment as shown and described in FIGS. 5 and 6 substitute coil springs 16 as shown in FIGS. 1, 2, and 3 for folded form springs 16'. Folded form springs 16' are manufactured from spring steel and are of the same diameter as torsion springs 15'. Intermediate folded form springs 16' are joined to torsion springs 15 by clamps 18' which act as joining means as shown. Folded form springs 16' are generally less expensive than coil springs 16, but provide intermediate support along torsion springs 15'. As further shown in FIG. 6, intermediate folded form springs 16' are attached by clip 18' to torsion spring 15' at its upper or top end and are secured by singular vase 19' to folded form spring rail 34'. As further shown, front rail 31' is affixed to side rails 32A, 32A' (FIG. 5) and rear rail 30' to form a wooden rectangular seating frame. Folded form spring rail 34' and torsion spring support rail 33' are affixed to side rails 32A, 32A' in spring assembly 10' to provide a spring assembly having "soft" front and rear ends as is known in the trade. Stiffening frame 20' acts as a stabilizer along the perimeter of the top of spring assembly 10'. Also, for the second embodiment that is shown in FIGS. 5 and 6, single lateral member 17A is attached to folded form springs 34, 34' and to torsion springs 15' by metal clamps 18'.

The rear area of spring assemblies 10, 10' would, in most applications, receive the greatest force or load during initial sitting. Accordingly, intermediate springs 16, 16' provide much-needed support to the rear area of spring assemblies 10, 10' to increase durability and resiliency. Also, various paddings, cushions, fabric webbing, and the like which are used to complete seat sections 13, 13' have been omitted to provide clarity to the inventions described as the illustrations and examples herein are for explanatory purposes and are not intended to limit the scope of the appended claims.

I claim:

1. In a spring assembly for a furniture seating frame, said frame having front and rear rails and utilizing a plurality of intermediately supported parallel torsion springs disposed therealong, the improvement for each of said intermediately supported torsion springs consisting of an intermediate folded form spring, means for joining each of said intermediate folded form springs to a different one of said torsion springs, each of said intermediate folded form springs being the sole intermediate folded form spring joined by said joining means to the different ones of said torsion springs to provide intermediate support thereto, a lateral member, said lateral member connecting all of said torsion springs at the position of said intermediate folded form spring, each of said intermediate folded form springs positioned approximately ⅔ of the distance from said front rail to said rear rail, proximate said rear rail, an intermediate spring rail, said intermediate spring rail affixed to said frame parallel to said front rail for supporting said intermediate folded form springs, and a stiffening frame, said stiffening frame surrounding said torsion springs.

2. The spring assembly of claim 1 wherein said lateral member comprises a metal rod.

3. The spring assembly of claim 1 wherein said torsion springs are formed from metal.

4. The spring assembly of claim 1 wherein said folded torsion springs are formed from metal.

5. The spring assembly of claim 1 wherein said rails are formed from wood.

6. In a spring assembly for a furniture seating frame, said frame having front and rear rails and utilizing a plurality of intermediately supported parallel torsion springs disposed therealong, the improvement for each of said intermediately supported torsion springs consisting of an intermediate coil spring, means for joining each of said intermediate coil springs to a different one of said torsion springs, each of said intermediate coil springs being the sole intermediate coil spring joined by said joining means to the different ones of said torsion springs to provide intermediate support thereto, a lateral member, said lateral member connecting all of said torsion springs at the position of said intermediate coil spring, each of said intermediate coil springs positioned approximately ⅔ of the distance from said front rail to said rear rail, proximate said rear rail, an intermediate spring rail, said intermediate spring rail affixed to said frame parallel to said front rail for supporting said intermediate coil springs, and a stiffening frame, said stiffening frame surrounding said torsion springs.

7. The spring assembly of claim 6 wherein said lateral member comprises a metal rod.

8. The spring assembly of claim 6 wherein said torsion springs are formed from metal.

9. The spring assembly of claim 6 wherein said folded torsion springs are formed from metal.

10. The spring assembly of claim 6 wherein said rails are formed from wood.

* * * * *